United States Patent [19]

Haines

[11] 4,033,085

[45] July 5, 1977

[54] BRICK TIE

[76] Inventor: Norman William Haines, 71 Saltly St., South Kingsville, Victoria, Australia

[22] Filed: Apr. 3, 1975

[21] Appl. No.: 564,980

[30] Foreign Application Priority Data

Apr. 4, 1974 Australia ..... 7156/74

[52] U.S. Cl. ..... 52/698; 52/715

[51] Int. Cl.[2] ..... E04B 1/38

[58] Field of Search ..... 52/698, 713, 715

[56] References Cited

UNITED STATES PATENTS

| | | | |
|---|---|---|---|
| 917,028 | 4/1909 | Ellery | 52/713 X |
| 2,213,355 | 9/1940 | Woodworth | 52/715 X |
| 3,405,495 | 10/1968 | Barbera | 52/715 X |
| 3,893,274 | 7/1975 | Salisbury | 52/698 |

FOREIGN PATENTS OR APPLICATIONS

| | | | |
|---|---|---|---|
| 990,421 | 4/1965 | United Kingdom | 52/715 |

OTHER PUBLICATIONS

Hohmann & Barnard Catalog "Steel Nailer Clips" p. 16 relied upon.

*Primary Examiner*—J. Karl Bell
*Attorney, Agent, or Firm*—Fred Philpitt

[57] ABSTRACT

A brick tie member composed of an elongated rigid member having notches at spaced apart intervals along its longitudinal edges.

5 Claims, 5 Drawing Figures

FIG. 1.
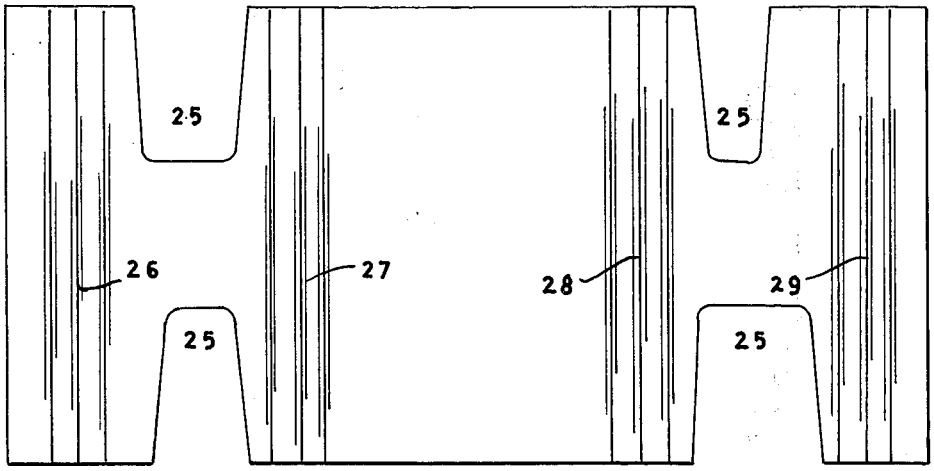
FIG. 2.
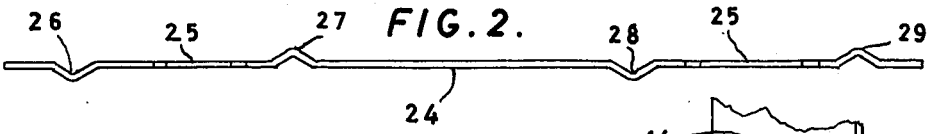
FIG. 3.
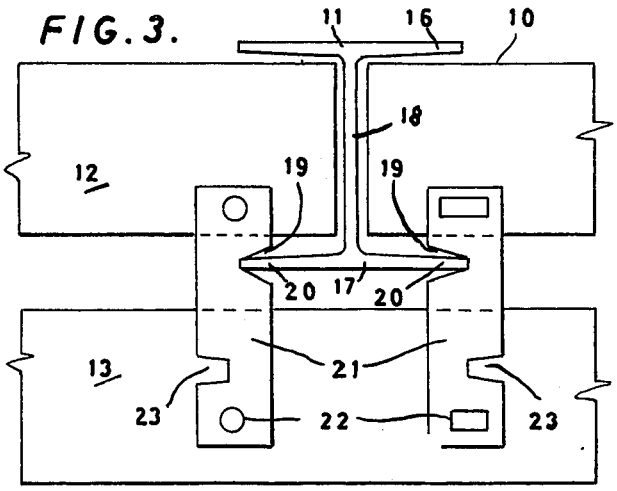
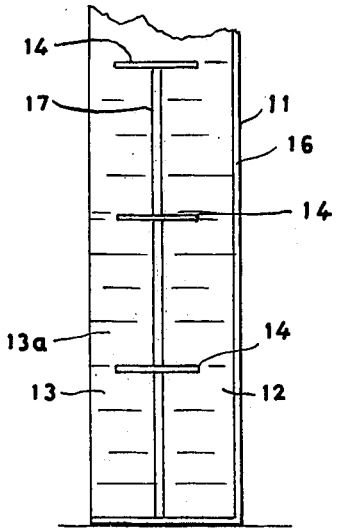
FIG. 4.
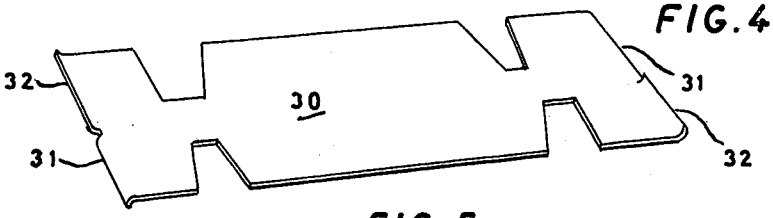
FIG. 5.

BRICK TIE

This invention relates to a brick tie for use in structures having a plurality of spaced vertical columns and an associated brick wall, wherein it is required to tie the brick wall to the columns. In the construction of buildings incorporating brick walls it is a requirement that the brick wall be anchored at specific intervals to the main structure of the building to provide additional support for the brick wall in order to withstand windloads and other side pressures, which may otherwise deflect the brick wall to such an extent that it will collapse.

In buildings having a steel frame and an enclosing brick wall it is required by building regulations for the brick wall to be anchored to the steel columns, and this is normally achieved by securing steel rods or the like to the column and embedded portion of the rod in the mortar between adjacent courses of bricks. At present the rod is secured to the column by welding or explosive fasteners but these methods are expensive. Normally the bricklayer is not skilled or permitted to carry out the welding operation or to operate explosive tools, and therefore, it is necessary for an additional workman to be available to effect the securing of the ties as the building of the brick wall progresses. However for a large portion of the time this additional workman is not performing useful work, but nevertheless must remain available to secure the ties when required.

It is the object of the present invention to provide a brick tie which will effectively anchor a brick wall to a building structure and may be fitted by the bricklayer without the aid of special tools or a skilled workman.

With this object in view there is provided a brick tie comprising an elongated member having adjacent one end a portion shaped to embrace a marginal edge portion of a structural member whereby when said embracing portion is fitted to the structural member and portion of the tie adjacent the other end is embedded in mortar between two courses of a brick structure the latter is restrained against movement relative to the structural member in a direction laterally of the embracing marginal edge portion.

Conveniently the shaped portion of the elongated member defines a notch or recess to receive the marginal edge portion of the structural member. The notch or recess may be provided by suitable shaping of the elongated member or may be formed by cutting the notch or recess into an edge of the member. The elongated member may be made of rod strip or bar materials, preferably of steel with a protective coating.

Normally the structural member will be in the form of a rolled or fabricated member having a pair of spaced flanges interconnected by a web, each flange extending in the direction of the length of the brick structure. The elongated member forming the brick tie is provided with a notch in one edge thereof which will receive the vertical marginal edge portion of one flange of the structural member. It will however be appreciated that the brick tie may take other forms dependent upon the shape of the structural member in association with which it will be used, the essential feature being that the portion of the brick tie will embrace some edge portion of the structural member and thereby be restrained against lateral movement relative to the structural member.

The portion of the tie at the end opposite the notched end is, in use, embedded in the mortar between two adjacent courses of bricks and is preferably shaped to provide a shoulder so that upon setting of the mortar there is an interlocking or keying effect between the tie and the mortar so that they are held together mechanically in addition to the bonding between the tie and the mortar. Some preferred forms of the end of the brick tie may include the provision of an aperture recess or notch therein, into which mortar will enter and on setting, form a mechanical interconnection. Similarly the end of the tie may be formed into a non-planar configuration so as to also provide a mechanical connection on the setting of the mortar.

In the preferred form, the brick member is provided with a notch extending inwardly from a longitudinal edge adjacent each end of the tie, so that either notch may be positioned to embrace the edge portion of the structural member and the other notch will then be embedded in the mortar to provide the desired mechanical connection. As the thickness of the marginal edge portion of the structural member to be embraced will vary dependent upon the overall size and strength of the member, and as it is desirable for the notch in the brick tie to be a reasonably close fit with the edge portion of the structural member, notches of different width may be provided at spaced locations along the edge or edges of the brick tie, and the bricklayer may select the notch of the appropriate width for any particular size structural member. Also, in order to accommodate varying thicknesses of the structural member the notches may be of a tapered form so that they may firmly fit the structural member.

In a more specific form the brick tie comprises a sheet metal strip having two opposite longitudinal edges, two notches in each longitudinal edge one adjacent each end thereof, each notch having a different nominal width and shaped to receive the edge portion of a flange of a structure member, two transverse ridges formed in the strip one projecting from each face of the strip one located between each end of the strip and the adjacent notches, and two further transverse ridges formed in the strip intermediate the notches one projecting from each face of the strip. The invention will be more readily understood from a consideration of the following detailed description of the preferred embodiments thereof, read in conjunction with the accompanying drawings therein:

FIG. 1 represents a plan view of a brick tie constructed in accordance with a preferred embodiment of this invention;

FIG. 2 represents an elevational view of the brick tie of FIG. 1;

FIG. 3 represents a practical arrangement of the invention showing a brick tie used in conjunction with a structural member and a brick structure;

FIG. 4 represents a side elevational view of the arrangement of FIG. 3; and

FIG. 5 represents a perspective view of an alternative form of the brick tie of the present invention.

Referring firstly to FIG. 3 of the drawings, there is shown a portion of a typical form of building construction 10 incorporating an H-section column 11 and associated brick walls 12 and 13. The brick ties 14 and 15 anchor the brick wall 13 to the steel column 11.

The H-section column member 11 has two spaced flanges 16 and 17 interconnected by the web 18, each flange projecting in the direction of the length of the brick walls. Each brick tie 14 is provided with a notch 19 in one longitudinal edge which will receive the vertical marginal edge portion 20 of one flange of the column member.

The portion 21 of the tie, at the end opposite the notched end is embedded in the mortar between two adjacent courses of bricks 13 and 13*a* as shown in FIG. 4. This end portion of the brick tie includes the provision of an aperture 22, of any selected shape into which mortar will enter and on setting, form a mechanical inter-anchorage between the tie and the brick wall.

In the form of brick tie illustrated in FIG. 3 there is provided notches 19 and 23 respectively extending inwardly from opposite edges of and adjacent opposite ends of the tie, so that either notch 19 or 23 may be positioned to embrace the edge portion of the structural member and the other notch will then be embedded in the mortar to provide the desired mechanical anchoring. Also the notches are tapered so that they will fit firmly onto the flange within a limited range of thickness.

A more advanced form of the brick tie is illustrated in FIGS. 1 and 2, generally indicated by the numeral 24 and includes four tapered notches 25 each being of a different nominal width so that a wide range of thicknesses of column flanges may be accommodated. The bricklayer can therefore select the notch which will provide the closest matching fit with the marginal portion 20 of the columns 11. The brick tie also incorporates two oppositely directed troughs 27 and 28 in the centre portion of the tie. As can be seen in FIG. 2 the forming of the trough in one side of the tie results in a ridge on the opposite side, each extending the full width of the tie. When in use the centre troughs or the resulting ridges will be located between the brick wall and column and thereby prevent moisture from passing therebetween along the tie. Similar further troughs 26 and 29 are provided adjacent each end of the tie, one of which will be embedded in the mortar between adjacent brick courses when in use thereby improving the anchoring of the brick wall to the tie.

Referring now to FIG. 5 of the drawings there is illustrated a brick tie having the same arrangement of notches as described with reference to FIG. 2 but incorporating lips 31 and 32 at each of the ends as an alternative to the troughs 26 and 29 aforementioned. One lip, 37, is downturned whilst the other lip, 32, is upturned. This embodiment could also be provided with the central troughs 27 and 28 as in FIG. 3 to provide the barrier to moisture.

In the various embodiments above described, the brick tie may be made from a strip of metal, preferably steel, having a width of approximately four inches and a thickness equivalent of 20 gauge. The notch as provided in each of the two opposite longitudinal edges of the strip are approximately 1 inch from the edge of the strip, and spaced in the longitudinal direction approximately 3 to 4 inches apart. Each notch extends inwardly from the edge of the strip approximately 1 inch and decreases in width from the edge to the innermost end. The width of one notch at the inner end is approximately ½ inch, whilst the width of the outer end is approximately ¾ inch. The troughs are 0.15 inch deep.

The strip is preferably coated with a protective material to prevent rust, which may be applied either before or after the forming of the notches.

It will be appreciated that the above dimensions are quoted purely by way of example and the width and thickness of the strip used is dependent upon the desired tensile structure of the tie member, whilst the shape and locations of the notches is dependent upon the actual form of the construction in which the tie is to be used.

The principal advantages arising from the presently proposed brick tie are:

1. They may be fitted by a bricklayer without additional tools or assistance.

2. They are not required to be pre-positioned on a structural member and may be fitted on any point along the length of the member to suit the courses of the bricks.

3. They are comparatively light in weight and may therefore be carried by the bricklayer.

4. They may be produced in high volume for use on a range of sizes of structural members.

I claim:

1. A brick tie comprising a sheet metal strip having two opposite longitudinal edges, two notches in each longitudinal edge one adjacent each end thereof, each notch having a different nominal width and shaped to receive the edge portion of a flange of a structure member, two transverse ridges formed in the strip one projecting from each face of the strip one located between each end of the strip and the adjacent notches, and two further transverse ridges formed in the strip intermediate the notches one projecting from each face of the strip.

2. A brick tie comprising:

an elongated rigid member having two ends and two longitudinal edges extending between said ends, a first notch extending inwardly from one of said longitudinal edges, a second notch extending inwardly from the other of said longitudinal edges, and at least one trough or ridge formed on at least one face of said elongated rigid member and extending across the width thereof, said trough or ridge being spaced from said notches toward the center of the elongated rigid member.

3. A brick tie as set forth in claim 2 including a further ridge or trough formed in one face of the member and extending at least partially across the width thereof said further ridge or trough being located between a notch and the end nearest that notch.

4. A brick tie as set forth in claim 2 having adjacent at least one end an abutment surface disposed at an angle to the direction of the length of the member, and projecting from the plane of the member.

5. A brick tie as set forth in claim 2 in which each notch is tapered with the wider part of the notch at the longitudinal edge.

* * * * *